US011231034B2

(12) United States Patent
Funakoshi et al.

(10) Patent No.: US 11,231,034 B2
(45) **Date of Patent: *Jan. 25, 2022**

(54) COMPRESSOR

(71) Applicant: Panasonic Intellectual Property Management Co., Ltd., Osaka (JP)

(72) Inventors: Daisuke Funakoshi, Shiga (JP); Akinori Fukuda, Shiga (JP); Hideto Oka, Shiga (JP); Kenji Watanabe, Shiga (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 73 days.

This patent is subject to a terminal disclaimer.

(21) Appl. No.: 16/641,534

(22) PCT Filed: Aug. 2, 2018

(86) PCT No.: PCT/JP2018/028954
§ 371 (c)(1),
(2) Date: Feb. 24, 2020

(87) PCT Pub. No.: WO2019/044350
PCT Pub. Date: Mar. 7, 2019

(65) Prior Publication Data

US 2020/0248687 A1 Aug. 6, 2020

(30) Foreign Application Priority Data

Sep. 4, 2017 (JP) ..... JP2017-169081

(51) Int. Cl.
*F04C 18/02* (2006.01)
*F04C 29/06* (2006.01)
(Continued)

(52) U.S. Cl.
CPC ..... *F04C 18/0215* (2013.01); *F04C 23/008* (2013.01); *F04C 29/04* (2013.01); *F04C 29/065* (2013.01); *F04C 29/128* (2013.01)

(58) Field of Classification Search
CPC ..... F04C 18/0215; F04C 29/04; F04C 29/06; F04C 29/065; F04C 29/066
See application file for complete search history.

(56) References Cited

U.S. PATENT DOCUMENTS 5,674,061 A 10/1997 Motegi et al.
5,951,272 A 9/1999 Fukuhara et al.
(Continued)

FOREIGN PATENT DOCUMENTS

CN 206054310 U 3/2017
EP 2 873 863 5/2015
(Continued)

OTHER PUBLICATIONS

International Search Report issued in International Application No. PCT/JP2018/028954, dated Oct. 16, 2018, 4 pages.
(Continued)

*Primary Examiner* — Mark A Laurenzi
*Assistant Examiner* — Xiaoting Hu
(74) *Attorney, Agent, or Firm* — Hamre, Schumann, Mueller & Larson, P.C.

(57) ABSTRACT

A compressor including fixed scroll and revolving scroll configuring compression mechanism, compression chamber formed between fixed scroll and revolving scroll, intake chamber provided on an outer circumferential side of fixed scroll, discharge port provided in a central part of fixed scroll, muffler provided to cover discharge port at an upper part of fixed scroll, and heat-insulating member provided between fixed scroll and muffler space formed by muffler. After a refrigerant gas taken into intake chamber is com-
(Continued)

pressed by revolving scroll revolving and compression chamber moving while changing a volume of compression chamber, the refrigerant gas is discharged from discharge port. The refrigerant gas discharged from discharge port is discharged into muffler space.

7 Claims, 7 Drawing Sheets

(51) Int. Cl.

| | |
|---|---|
| ***F04C 29/04*** | (2006.01) |
| ***F04C 29/12*** | (2006.01) |
| ***F04C 23/00*** | (2006.01) |

(56) References Cited

U.S. PATENT DOCUMENTS

| | | | | |
|---|---|---|---|---|
| 2005/0169787 | A1* | 8/2005 | Iguchi | F04B 39/121 418/55.5 |
| 2010/0061871 | A1 | 3/2010 | Arai et al. | |
| 2016/0305430 | A1* | 10/2016 | Mahure | F04C 18/0215 |
| 2021/0156381 | A1 | 5/2021 | Watanabe et al. | |

FOREIGN PATENT DOCUMENTS

| | | | | |
|---|---|---|---|---|
| EP | 2873863 | A1 * | 5/2015 | F04C 23/008 |
| JP | 61-095997 | | 6/1986 | |
| JP | 62-265487 | | 11/1987 | |
| JP | 5-033784 | | 2/1993 | |
| JP | 2005-201114 | | 7/2005 | |
| JP | 2007-247601 | | 9/2007 | |
| JP | 2016-094824 | | 5/2016 | |
| JP | 2017-075538 | | 4/2017 | |
| WO | 2014/002456 | | 1/2014 | |

OTHER PUBLICATIONS

English Translation of Chinese Search Report dated Apr. 8, 2021 for the related Chinese Patent Application No. 201880053186.3, 2 pages.

International Search Report issued in International Application No. PCT/JP2018/028953, dated Oct. 16, 2018, 4 pages.

U.S. Appl. No. 16/641,523, filed Feb. 24, 2020, US 2021/0156381.

* cited by examiner

COMPRESSOR

TECHNICAL FIELD

The present disclosure relates to a compressor used for a cooling device such as a heating-cooling air conditioner and a refrigerator, a heat pump type water heater, and the like.

BACKGROUND ART

Conventionally, a hermetic compressor used for a cooling device, a water heater, and the like plays a role of compressing a refrigerant gas returned from a refrigeration cycle in a compression mechanism and sending the refrigerant gas to the refrigeration cycle. The refrigerant gas returned from the refrigeration cycle is supplied to a compression chamber formed in the compression mechanism through an intake route. After that, the refrigerant gas that has been compressed to have a high temperature and high pressure is discharged from the compression mechanism into an airtight container and sent from a discharge pipe provided in the airtight container to the refrigeration cycle (for example, see PTL 1).

FIG. 7 is a sectional view showing the compression mechanism of the conventional scroll compressor described in PTL 1.

A low-temperature and low-pressure refrigerant gas passes through intake pipe 101, is led to the intake chamber of fixed scroll 102, and compressed by a volume change of compression chamber 103 to have a high temperature and high pressure. After that, the high-temperature and high-pressure refrigerant gas passes through discharge port 104 at an upper part of fixed scroll 102, is discharged into muffler space 106 configured with fixed scroll 102 and muffler 105 covering the upper part of fixed scroll 102, and is sent from discharge pipe 108 to the refrigeration cycle through an inside of airtight container 107 from muffler space 106.

CITATION LIST

Patent Literature

PTL 1: Unexamined Japanese Patent Publication No. 2007-247601

SUMMARY OF THE INVENTION

In the compressor having the configuration of FIG. 7, however, the low-temperature refrigerant led to the intake chamber of fixed scroll 102 is affected by heat (for example, being heated) of the highest-temperature and highest-pressure refrigerant gas discharged from discharge port 104 at the upper part of fixed scroll 102 into muffler space 106.

As a result, the refrigerant gas expands when being confined in compression chamber 103. Accordingly, a circulation amount of the refrigerant gas decreases.

Moreover, since a refrigerant gas that is being compressed in compression chamber 103 passes through fixed scroll 102 from muffler space 106, the refrigerant gas is also affected by heat of the high-temperature and high-pressure refrigerant gas. As a result, the refrigerant gas expands, and a compression loss of a refrigerant increases.

The present disclosure solves the conventional problems described above, and an object of the present disclosure is to provide a highly efficient compressor through suppression of a decrease in a circulation amount of a refrigerant and reduction of a compression loss of the refrigerant.

The compressor of the present disclosure includes a fixed scroll and a revolving scroll configuring a compression mechanism, a compression chamber formed between the fixed scroll and the revolving scroll, an intake chamber provided on an outer circumferential side of the fixed scroll, a discharge port provided in a central part of the fixed scroll, a muffler provided to cover the discharge port at an upper part of the fixed scroll, and a heat-insulating member provided between the fixed scroll and a muffler space formed by the muffler. After a refrigerant gas taken into the intake chamber is compressed by the revolving scroll revolving and the compression chamber moving while changing a volume of the compression chamber, the refrigerant gas is discharged from the discharge port. The refrigerant gas discharged from the discharge port is discharged into the muffler space.

By so doing, the heat-insulating member provided between the upper part of the fixed scroll and the muffler serves as a heat-insulating layer. Therefore, the heat-insulating member suppresses the influence of heat from the muffler space through which a highest-temperature and highest-pressure refrigerant passes into the intake chamber and compression chamber before compression starts when the fixed scroll has a lowest temperature.

Moreover, together with the muffler space, the heat-insulating member suppresses the influence of heat from a high-temperature refrigerant in a space inside a container above the muffler space upon the fixed scroll. Accordingly, an increase in the temperature of the refrigerant is suppressed, a decrease in the circulation amount of the refrigerant is prevented, and an increase in the compression loss of the refrigerant is suppressed. As a result, a highly efficient compressor can be achieved.

Further, at a time of prevention of a decrease in the circulation amount of the refrigerant and suppression of an increase in the compression loss of the refrigerant, a shape of the fixed scroll need not be changed. Therefore, while an increase in a volume of the discharge port provided in the fixed scroll is suppressed and a discharge dead volume is maintained minimum, prevention of a decrease in the circulation amount of the refrigerant and suppression of an increase in the compression loss of the refrigerant can be achieved.

According to the present disclosure, while the discharge dead volume is maintained minimum, an increase in a temperature of a refrigerant can be suppressed, a decrease in a circulation amount of the refrigerant can be prevented, and an increase in a compression loss of the refrigerant can be suppressed. As a result, a highly efficient compressor can be provided.

DESCRIPTION OF EMBODIMENT

Figure 1:
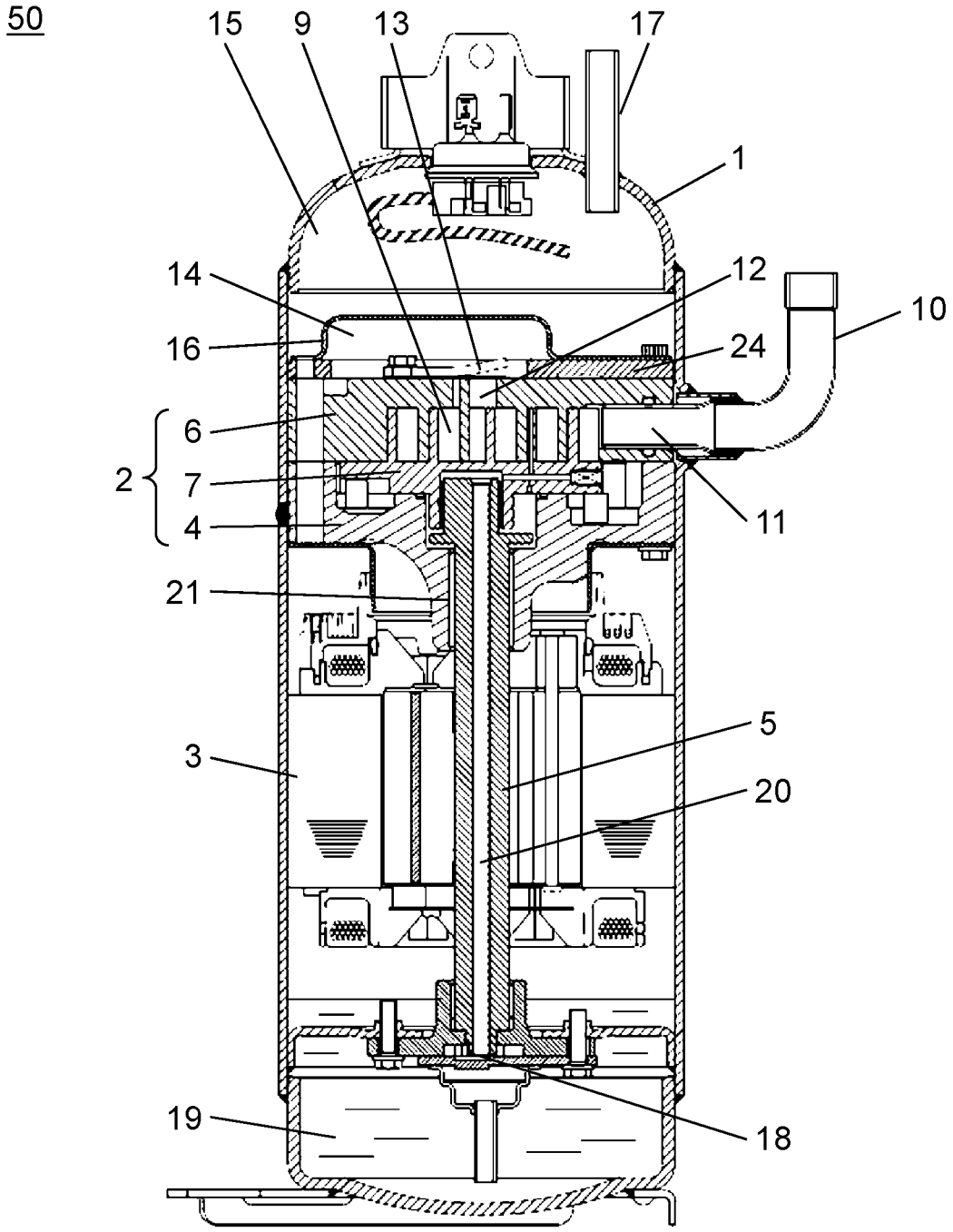
FIG. 1 is a view showing one example of a cross section of a compressor according to a first exemplary embodiment of the present disclosure viewed from a side.

The compressor of a first aspect of the present disclosure includes a fixed scroll and a revolving scroll configuring a compression mechanism, a compression chamber formed between the fixed scroll and the revolving scroll, an intake chamber provided on an outer circumferential side of the fixed scroll, a discharge port provided in a central part of the fixed scroll, a muffler provided to cover the discharge port at an upper part of the fixed scroll, and a heat-insulating member provided between the fixed scroll and a muffler space formed by the muffler. After a refrigerant gas taken into the intake chamber is compressed by the revolving scroll revolving and the compression chamber moving while changing a volume of the compression chamber, the refrigerant gas is discharged from the discharge port. The refrigerant gas discharged from the discharge port is discharged into the muffler space.

By so doing, the heat-insulating member provided between the upper part of the fixed scroll and the muffler serves as a heat-insulating layer. Therefore, the heat-insulating member suppresses the influence of heat from the muffler space through which a highest-temperature and highest-pressure refrigerant passes into the intake chamber and compression chamber before compression starts when the fixed scroll has a lowest temperature.

Moreover, together with the muffler space, the heat-insulating member suppresses the influence of heat from a high-temperature refrigerant in a space inside a container above the muffler space upon the fixed scroll. Accordingly, an increase in the temperature of the refrigerant is suppressed, a decrease in the circulation amount of the refrigerant is prevented, and an increase in the compression loss of the refrigerant is suppressed. As a result, a highly efficient compressor can be achieved.

Further, at a time of prevention of a decrease in the circulation amount of the refrigerant and suppression of an increase in the compression loss of the refrigerant, a shape of the fixed scroll need not be changed. Therefore, while an increase in a volume of the discharge port provided in the fixed scroll is suppressed and a discharge dead volume is maintained minimum, prevention of a decrease in the circulation amount of the refrigerant and suppression of an increase in the compression loss of the refrigerant can be achieved.

In a second aspect of the present disclosure, the heat-insulating member may have a recess provided between the muffler space and the intake chamber.

By so doing, since a refrigerant gas and oil in the refrigerant gas intrude into the recess provided in the heat-insulating member and stay in the recess, the recess serves as a heat-insulating layer. Therefore, a combination of a heat insulation action by the recess in which the refrigerant gas and the oil in the refrigerant gas stay and a heat insulation action of the heat-insulating member provides a high heat insulation effect. As a result, the influence of heat by the high-temperature refrigerant in the muffler space is strongly suppressed (for example, blocked). Accordingly, in the present disclosure, in addition, an increase in the temperature of the refrigerant is effectively suppressed, a decrease in the circulation amount of the refrigerant is prevented, and an increase in the compression loss of the refrigerant is suppressed. As a result, a highly efficient compressor can be achieved.

In a third aspect of the present disclosure, the recess may also be provided in an area other than an area between the muffler space and the intake chamber.

By so doing, the heat-insulating layer by the recess of the heat-insulating member can further strongly suppress the influence of heat upon the compression chamber of the fixed scroll from the space inside a container above the muffler space in which a relatively high-temperature refrigerant exists. Therefore, a decrease in the circulation amount of the refrigerant due to an increase in the temperature of the refrigerant is further effectively suppressed, and an increase in the compression loss of the refrigerant is suppressed. As a result, a highly efficient compressor can be provided.

In a fourth aspect of the present disclosure, a portion close to the muffler space of the heat-insulating member may be fixed to the fixed scroll by a bolt.

By so doing, airtightness between the portion close to the muffler space of the heat-insulating member and the recess improves. This prevents a decrease in the heat insulation effect by the recess due to a heat exchange by circulation between the high-temperature and high-pressure refrigerant inside the muffler space and the refrigerant inside the recess. As a result, a high heat insulation effect by the recess is maintained. Therefore, the effect of prevention of a decrease in the circulation amount of the refrigerant due to an increase in the temperature of the refrigerant, and the effect of suppression of an increase in the compression loss of the refrigerant are further enhanced. As a result, a highly efficient compressor can be provided.

In a fifth aspect of the present disclosure, the heat-insulating member may further include a reed valve that opens and closes the discharge port and an opening that serves as a relief section of the reed valve, and the heat-insulating member may have a configuration in which at least one of a rim of the opening and an opening edge of the recess has a protruding shape most protruding toward a side of the fixed scroll.

By so doing, the protruding shape of the heat-insulating member comes into pressure contact with an upper surface of the fixed scroll. Accordingly, an area between the muffler space and the recess is strongly blocked. This prevents a decrease in the heat insulation effect by the recess due to a heat exchange by circulation between the high-temperature and high-pressure refrigerant inside the muffler space and the refrigerant inside the recess. Accordingly, the high heat insulation effect by the recess is maintained. Therefore, the effect of prevention of a decrease in the circulation amount of the refrigerant due to an increase in the temperature of the refrigerant, and the effect of suppression of an increase in the compression loss of the refrigerant are further enhanced. As a result, a highly efficient compressor can be provided.

In a sixth aspect of the present disclosure, the heat-insulating member may be formed of a porous material such as sintered metal.

By so doing, the heat-insulating member has low heat conductivity. Accordingly, the heat insulation effect of the heat-insulating member is enhanced. As a result, the influence of heat from the high-temperature and high-pressure refrigerant in the muffler space, and the influence of heat from the refrigerant inside the container above the muffler space are further strongly suppressed. Therefore, a decrease in the circulation amount due to an increase in the temperature of the refrigerant is more effectively suppressed, and an increase in the compression loss of the refrigerant is suppressed. As a result, a highly efficient compressor can be provided.

In a seventh aspect of the present disclosure, a plurality of plates may be laminated to form the heat-insulating member.

By so doing, in the heat-insulating member, heat conduction decreases between the respective plates. Accordingly, the heat insulation effect of the heat-insulating member is enhanced. As a result, the influence of heat from the high-temperature and high-pressure refrigerant in the muffler space, and the influence of heat from the refrigerant inside the container above the muffler space are further strongly suppressed. Moreover, among the plurality of plates, when a thickness of plates facing the fixed scroll is thin, the plates facing the fixed scroll have high adhesion to the upper surface of the fixed scroll. As a result, the heat exchange due to the circulation between the refrigerant inside the recess and the high-temperature and high-pressure refrigerant inside the muffler space is more reliably prevented. Therefore, a decrease in a circulation amount due to an increase in the temperature of the refrigerant is effectively suppressed, and an increase in the compression loss of the refrigerant is suppressed. As a result, a highly efficient compressor can be provided.

In an eighth aspect of the present disclosure, the plurality of plates may include a plate having a recess.

By so doing, the plurality of plates includes plates having the recess. Therefore, a heat-insulating member having a recess is formed without performing cutting and the like. Moreover, among the plurality of plates, when a thickness of plates facing the fixed scroll is thin, the plates facing the fixed scroll have high adhesion to the upper surface of the fixed scroll. As a result, the heat exchange due to the circulation between the refrigerant inside the recess and the high-temperature and high-pressure refrigerant inside the muffler space is strongly prevented. Therefore, a decrease in the circulation amount of the refrigerant due to an increase in the temperature is more efficiently prevented, and an increase in the compression loss of the refrigerant is suppressed. As a result, a highly efficient compressor can be provided.

Hereinafter, an exemplary embodiment of the present disclosure will be described in detail with reference to the drawings. Note that these exemplary embodiments do not limit the present disclosure.

First Exemplary Embodiment

Figure 2:
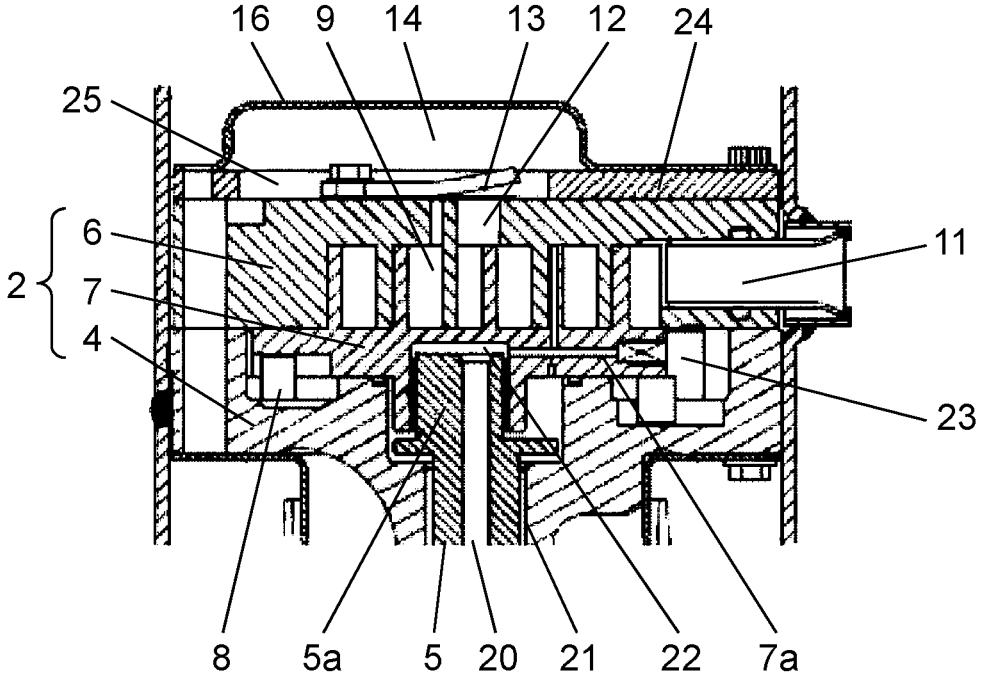
FIG. 2 is a view showing one example of a cross section of a main part of the compressor according to the first exemplary embodiment of the present disclosure.
Figure 3:
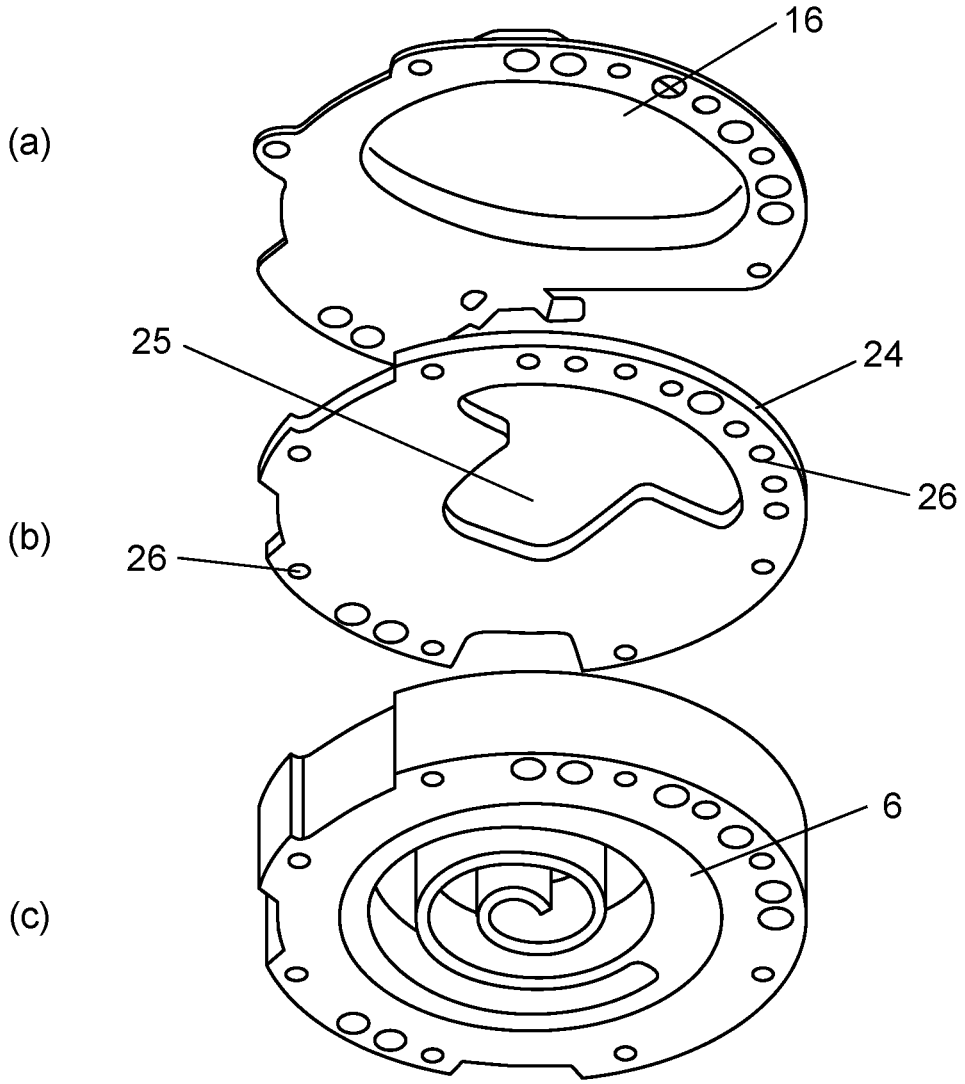
FIG. 3 is a perspective view showing one example of a muffler, a heat-insulating member, and a fixed scroll of the compressor according to the first exemplary embodiment of the present disclosure.

FIG. 1 is a view showing one example of a cross section of compressor 50 according to a first exemplary embodiment of the present disclosure viewed from a side. FIG. 2 is a view showing one example of a cross section of a main part of compressor 50 according to the first exemplary embodiment of the present disclosure. FIG. 3 is a perspective view showing one example of muffler 16, heat-insulating member 24, and fixed scroll 6 of compressor 50 according to the first exemplary embodiment of the present disclosure. Part (a) of FIG. 3 is a perspective view of muffler 16 of compressor 50 viewed from below. Part (b) of FIG. 3 is a perspective view of heat-insulating member 24 of compressor 50 viewed from below. Part (c) of FIG. 3 is a perspective view of fixed scroll 6 of compressor 50 viewed from below.

As shown in FIG. 1, compressor 50 of the present exemplary embodiment includes airtight container 1, compression mechanism 2 provided inside airtight container 1, and electric motor 3 provided inside airtight container 1.

Main bearing member 4 is fixed inside airtight container 1 by welding, shrinkage fitting, or the like. Shaft 5 is supported by main bearing member 4.

Fixed scroll 6 is bolted to an upper part of main bearing member 4. Revolving scroll 7 meshed with fixed scroll 6 is inserted between fixed scroll 6 and main bearing member 4 so as to configure scroll compression mechanism 2.

Rotation retaining mechanism 8 including an Oldham ring or the like that prevents rotation of revolving scroll 7 and guides revolving scroll 7 to have a circular orbit motion is provided between revolving scroll 7 and main bearing member 4.

Rotation retaining mechanism 8 causes revolving scroll 7 to have a circular orbit motion by eccentrically driving revolving scroll 7 by eccentric shaft 5*a* on an upper end of shaft 5. By so doing, compression chamber 9 formed between fixed scroll 6 and revolving scroll 7 moves from an outer circumferential side toward a central part while contracting a volume of compression chamber 9. Through using of this motion, a refrigerant gas is taken in from intake pipe 10 continued to a refrigeration cycle outside airtight container 1 through intake chamber 11 provided in the fixed scroll between intake pipe 10 and compression chamber 9 and always having an intake pressure. The refrigerant gas taken in is compressed after being confined in compression chamber 9. The refrigerant gas that has reached a prescribed pressure pushes and opens reed valve 13 and is discharged from discharge port 12 in a central part of fixed scroll 6.

The refrigerant gas that has been discharged after pushing and opening reed valve 13 is discharged into muffler space 14, and is sent to the refrigeration cycle from discharge pipe 17 through space inside container 15 of airtight container 1. Note that muffler space 14 is formed by muffler 16 whose circumference is fixed by fixed scroll 6, and covers discharge port 12 and reed valve 13.

On the other hand, pump 18 is provided on a lower end of shaft 5 that revolves and drives revolving scroll 7. A suction port of pump 18 is disposed so as to exist inside oil storage unit 19. Pump 18 operates concurrently with a scroll compressor. Therefore, pump 18 reliably pumps up oil in oil storage unit 19 provided at a bottom of airtight container 1 regardless of a pressure condition and an operation speed.

The oil pumped up by pump 18 is supplied to compression mechanism 2 through oil supply hole 20 that penetrates through an inside of shaft 5. Before or after the oil is pumped up by pump 18, a foreign matter is removed from the oil by an oil filter or the like. This prevents the foreign matter from being mixed into compression mechanism 2. As a result, reliability of compression mechanism 2 can be improved.

Pressure of the oil led to compression mechanism 2 is approximately equivalent to a discharge pressure of the scroll compressor. Moreover, the pressure of the oil led to compression mechanism 2 also serves as a back pressure source for revolving scroll 7. By so doing, revolving scroll 7 stably exerts a prescribed compression function without leaving from or coming into deviated contact with fixed scroll 6. Moreover, a part of the oil intrudes into a fitting portion between eccentric shaft 5*a* and revolving scroll 7, and bearing 21 between shaft 5 and main bearing member 4, as though the oil has tried to find a place to escape by a supply pressure and a weight of the oil, and drops after lubricating the respective portions, to return to oil storage unit 19.

Another part of the oil supplied from oil supply hole 20 to high pressure area 22 intrudes into back pressure chamber 23 in which rotation retaining mechanism 8 is located through route 7*a* formed by revolving scroll 7 and having a one-opening end in high pressure area 22. The intruded oil plays a role of applying a back pressure to revolving scroll 7 in back pressure chamber 23 in addition to lubrication of a thrust sliding unit and a sliding unit of rotation retaining mechanism 8.

As described above, the refrigerant gas to be compressed in compression mechanism 2 is compressed after being taken into compression chamber 9 between fixed scroll 6 and revolving scroll 7 via intake chamber 11 provided in fixed scroll 6. However, the refrigerant gas to be compressed by compression mechanism 2 is affected by heat of a highest-temperature and highest-pressure refrigerant gas that is discharged from discharge port 12 of fixed scroll 6 into muffler space 14.

Therefore, in the present disclosure, heat-insulating member 24 having a plate shape is provided between fixed scroll 6 and muffler 16 that forms muffler space 14, and a part of heat-insulating member 24 is configured so as to be located between muffler space 14 and intake chamber 11.

Heat-insulating member 24 has reed valve 13 for opening and closing the discharge port of fixed scroll 6. Moreover, in a part of heat-insulating member 24, opening 25 is provided to allow reed valve 13 to be located, in other words, serve as a relief section of reed valve 13. Another part of heat-insulating member 24 is configured so as to be located between an area of muffler space 14 other than reed valve 13 and fixed scroll 6. Moreover, bolts (not shown) are inserted into holes 26 provided on an outer circumferential portion to fix heat-insulating member 24 to fixed scroll 6 together with muffler 16.

By so doing, a portion other than opening 25 of heat-insulating member 24 is located between intake chamber 11 and compression chamber 9 of fixed scroll 6, and muffler space 14. Therefore, the portion other than opening 25 of heat-insulating member 24 serves as a heat-insulating layer and suppresses the influence of heat from the highest-temperature and highest-pressure refrigerant inside muffler space 14 upon intake chamber 11 and compression chamber 9. This means that a decrease in the circulation amount accompanying an increase in the temperature of the refrigerant in intake chamber 11 and compression chamber 9 and an increase in the compression loss of the refrigerant are suppressed. As a result, a highly efficient compressor can be achieved.

Moreover, the portion other than the opening 25 of heat-insulating member 24 is also located between space inside container 15 of airtight container 1 and fixed scroll 6. By so doing, together with muffler space 14, the portion other than opening 25 of heat-insulating member 24 suppresses the influence of heat from a high-temperature refrigerant in space inside container 15 above the muffler space upon fixed scroll 6. As a result, compared to a case where heat-insulating member 24 is not provided, the temperature of fixed scroll 6 is maintained low. Also from this perspective, a decrease in the circulation amount of the refrigerant is prevented, and an increase in the compression loss of the refrigerant is suppressed. As a result, a highly efficient compressor can be achieved.

Further, according to the configuration of the present exemplary embodiment, at the time of prevention of a decrease in the circulation amount of the refrigerant and suppression of an increase in the compression loss of the refrigerant, a shape of fixed scroll 6 need not be changed. Therefore, an increase in a volume of discharge port 12 provided in fixed scroll 6 is suppressed. This means that according to the configuration of the present exemplary embodiment, compared to the case where heat-insulating member 24 is not provided, while a discharge dead volume is maintained unchanged and minimum, prevention of a decrease in the circulation amount of the refrigerant and suppression of an increase in the compression loss of the refrigerant can be achieved.

Moreover, in the present exemplary embodiment, as one example, heat-insulating member 24 is formed of sintered metal. Therefore, an increase in the temperature of the refrigerant is efficiently suppressed. Sintered metal has low heat conductivity and a large number of micro spaces. Since sintered metal has high heat insulation, heat-insulating member 24 formed of sintered metal can efficiently suppress the influence of heat from the high-temperature refrigerant in muffler space 14 and space inside container 15. Through forming of heat-insulating member 24 with sintered metal, the heat insulation effect by heat-insulating member 24 is enhanced. Accordingly, an increase in the temperature of the refrigerant is more efficiently suppressed, a decrease in the circulation amount of the refrigerant is prevented, and an increase in the compression loss of the refrigerant is suppressed. As a result, a highly efficient compressor can be achieved.

Note that a material of heat-insulating member 24 is not limited to a porous material such as sintered metal. For example, as long as the material has low heat conductivity, any material such as a resin material can be used.

Moreover, heat-insulating member 24 may be one sheet, or may be configured through lamination of a plurality of plates. In laminated heat-insulating member 24 configured through lamination of the plurality of plates, heat conduction between the respective plates is strongly suppressed (in some cases, blocked). Therefore, the heat insulation effect improves and thus this configuration is effective.

Moreover, in the present exemplary embodiment, a member having a prescribed shape in advance is used as heat-insulating member 24. Heat-insulating member 24, however, may be formed, for example, between fixed scroll 6 and muffler space 14 by injection molding.

Second Exemplary Embodiment

Figure 5:
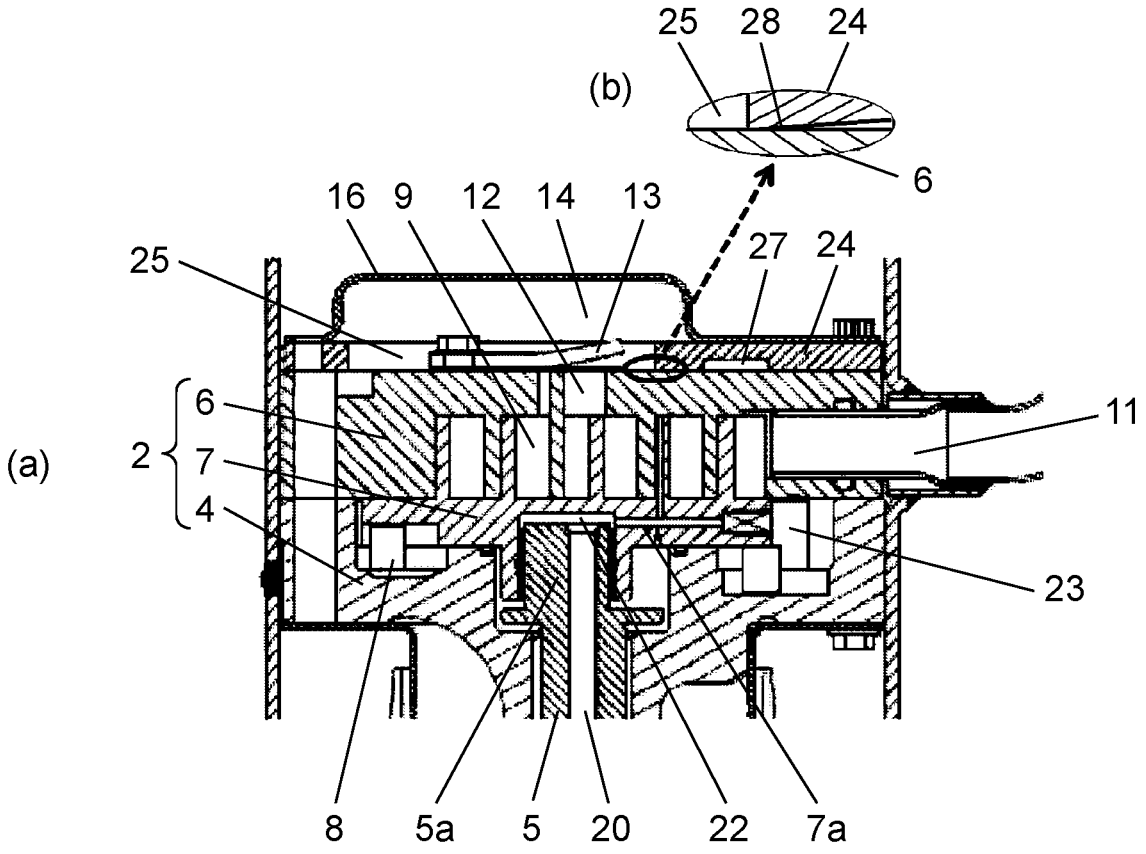
FIG. 5 is a view showing one example of a main part of a compressor according to a second exemplary embodiment of the present disclosure.
Figure 6:
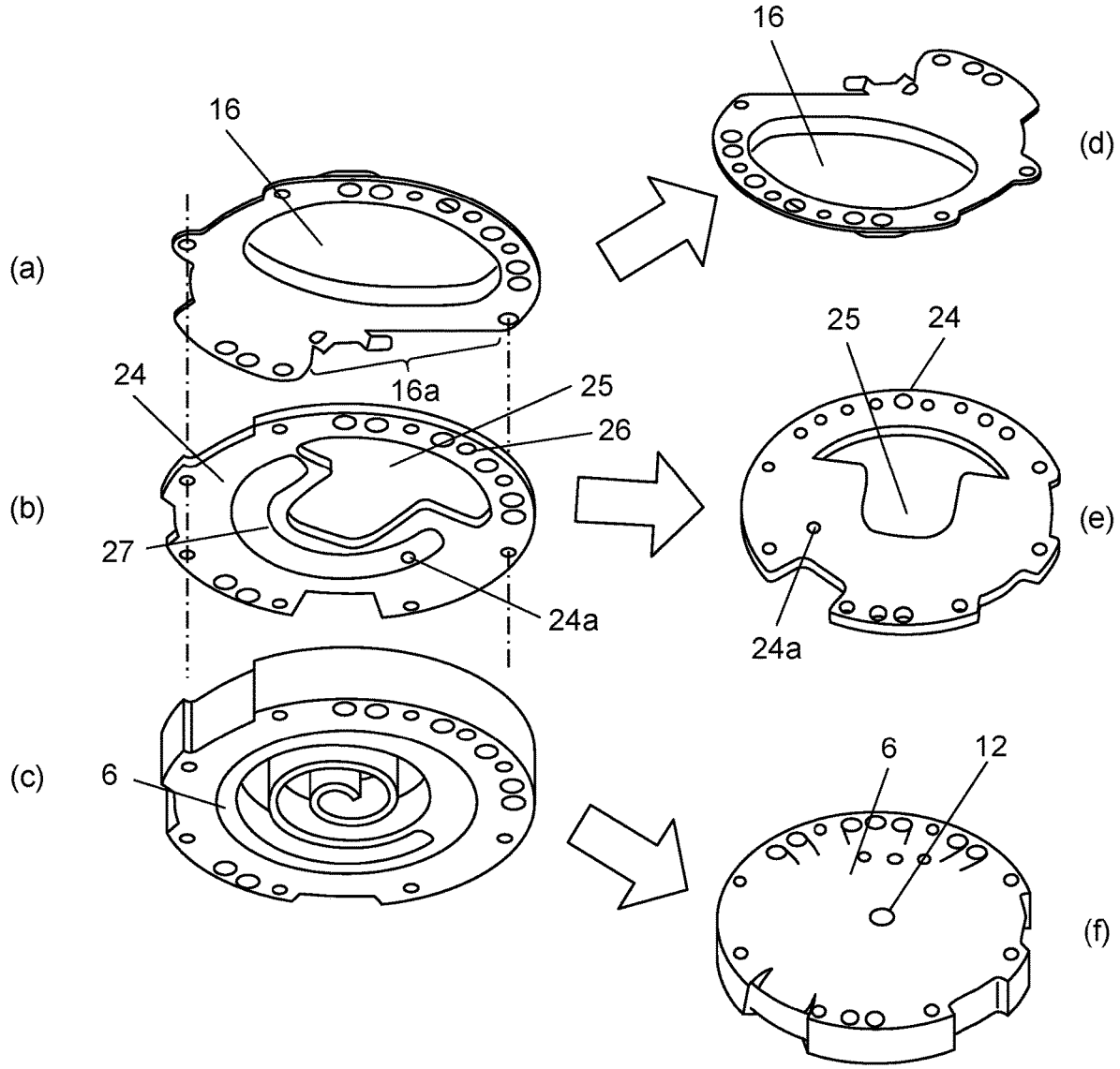
FIG. 6 is a perspective view showing one example of a muffler, a heat-insulating member, and a fixed scroll of the compressor according to the second exemplary embodiment of the present disclosure.
Figure 7:
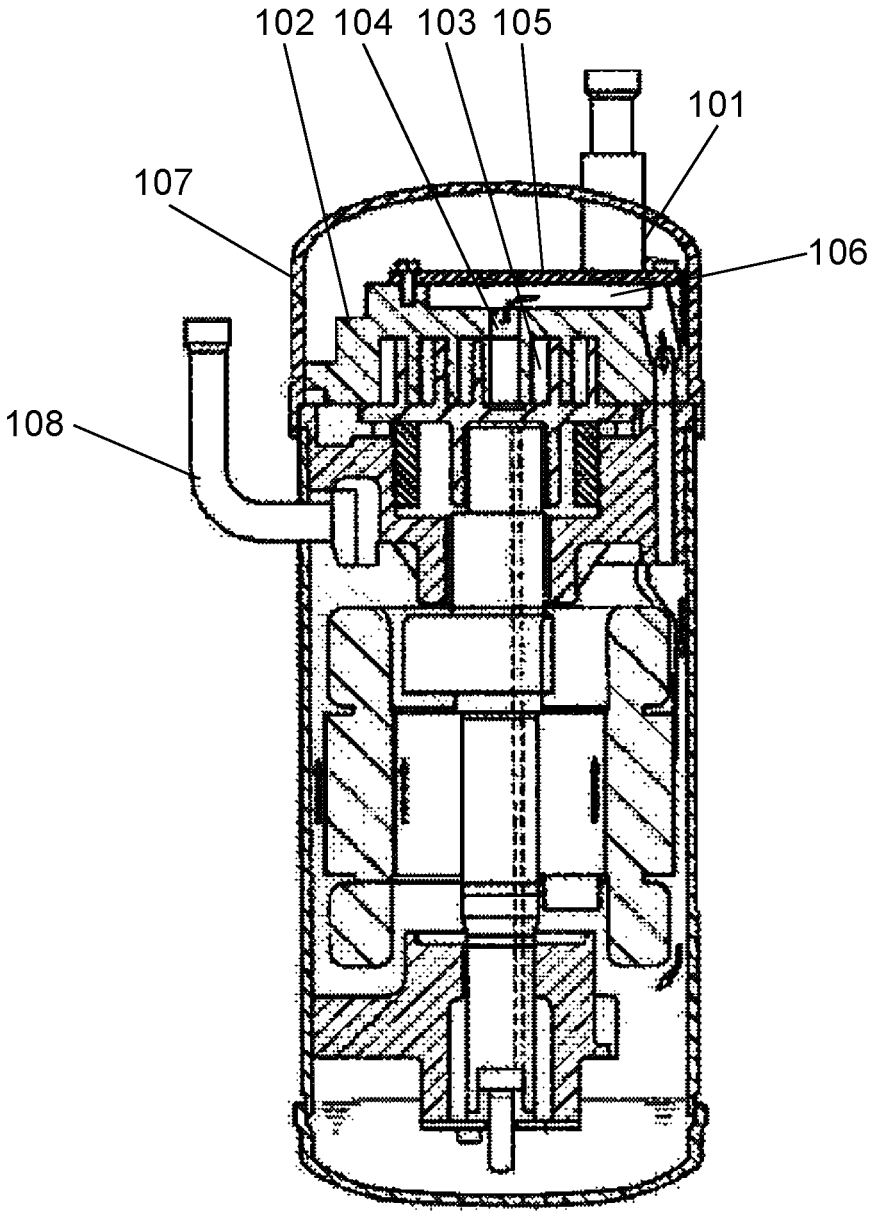
FIG. 7 is a view showing one example of a cross section of a scroll compressor in a comparative example viewed from a side.

FIG. 5 is a view showing one example of a main part of compressor 50 according to a second exemplary embodiment of the present disclosure. Part (a) of FIG. 5 is a sectional view, and part (b) of FIG. 5 is a detailed view showing one example of a configuration of heat-insulating member 24 and fixed scroll 6. FIG. 6 is a perspective view showing one example of muffler 16, heat-insulating member 24, and fixed scroll 6 of compressor 50 according to the second exemplary embodiment of the present disclosure. Part (a) of FIG. 6 is a perspective view of muffler 16 of compressor 50 viewed from below. Part (b) of FIG. 6 is a perspective view of heat-insulating member 24 of compressor 50 viewed from below. Part (c) of FIG. 6 is a perspective view of fixed scroll 6 of compressor 50 viewed from below. Part (d) of FIG. 6 is a perspective view of muffler 16 of compressor 50 viewed from a side of heat-insulating member 24. Part (e) of FIG. 6 is a perspective view of heat-insulating member 24 of compressor 50 viewed from above. Part (0 of FIG. 6 is a perspective view of fixed scroll 6 of compressor 50 viewed from above.

In the second exemplary embodiment, in heat-insulating member 24 of compressor 50, recess 27 is provided on a surface on a side facing fixed scroll 6. Recess 27 is formed as widely as possible so as to be located in an area other than an area overlapping with muffler space 14, in addition to the area overlapping with muffler space 14. Therefore, recess 27 has a shape along a rim of opening 25.

In heat-insulating member 24, through hole 24*a* is formed in a portion facing space inside container 15 via notch 16*a* of muffler 16 (see FIG. 6). Moreover, heat-insulating member 24 has protruding shape 28 in which the rim of opening 25 is highest when a plane surface of the surface on the side facing fixed scroll 6 is viewed from a side surface (see FIG. 5). Therefore, when the outer circumferential portion of heat-insulating member 24 is fixed to fixed scroll 6 together with muffler 16, the portion having protruding shape 28 of heat-insulating member 24 strongly comes into pressure contact with an upper surface of fixed scroll 6. Accordingly, an area between muffler space 14 and recess 27 is strongly blocked.

Other basic configurations are the same as those in the first exemplary embodiment. Therefore, the same component parts as those in the first exemplary embodiment are donated by the same reference numerals and description of the component parts is omitted.

In the compressor configured as described above, a high-temperature and high-pressure refrigerant released into space inside container 15 and oil inside the refrigerant intrude into recess 27 via through hole 24*a* and stay in recess 27 of heat-insulating member 24. By so doing, recess 27 has a lower temperature than the highest-temperature and highest-pressure refrigerant inside muffler space 14. Therefore, the stay of the refrigerant and oil inside recess 27 serves as a heat-insulating layer. By so doing, a heat insulation action by heat-insulating member 24 and a heat insulation action by recess 27 are combined together to provide a high heat insulation effect. This means that the stay of the refrigerant and the oil in recess 27 greatly reduces the influence of heat from muffler space 14 to intake chamber 11 and compression chamber 9. Accordingly, a suppression effect by heat-insulating member 24 and a suppression effect by recess 27 are combined together to provide a strong heat insulation effect.

Therefore, the influence of heat by the high-temperature refrigerant in muffler space 14 is strongly suppressed, a decrease in the circulation amount due to an increase in the temperature of the refrigerant is more efficiently prevented, and an increase in the compression loss of the refrigerant is suppressed. As a result, a highly efficient compressor can be provided.

Here, as a configuration of suppression of the influence of heat upon intake chamber 11 or the like from muffler space 14, for example, a configuration can be considered in which a recess similar to recess 27 of the present exemplary embodiment is provided on the surface on the side facing fixed scroll 6 to close the recess provided in the fixed scroll by a closing plate or the like. Through a configuration in which oil stays in the recess provided in the fixed scroll, the recess provided in the fixed scroll exerts a heat insulation effect and prevents the influence of heat upon intake chamber 11 or the like.

However, in a case of this configuration, a thickness of an area in which the recess is provided is added to the thickness of fixed scroll 6. As a result, the volume of discharge port 12 (dead volume) formed in fixed scroll 6 increases. Accordingly, the refrigerant compressed by compression chamber 9 expands when being discharged into discharge port 12. As a result, the suppression effect for a decrease in the circulation amount of the refrigerant by heat insulation of the recess provided in the fixed scroll cancels out.

According to the configuration of the present exemplary embodiment, however, recess 27 is provided in heat-insulating member 24 instead of fixed scroll 6. Therefore, the shape of fixed scroll 6 need not be changed. As a result, a problem such as an increase in the volume of discharge port 12 does not occur. This means that the circulation amount of the refrigerant reliably increases while the discharge dead volume is maintained minimum. As a result, a highly efficient compressor can be achieved.

Figure 4:
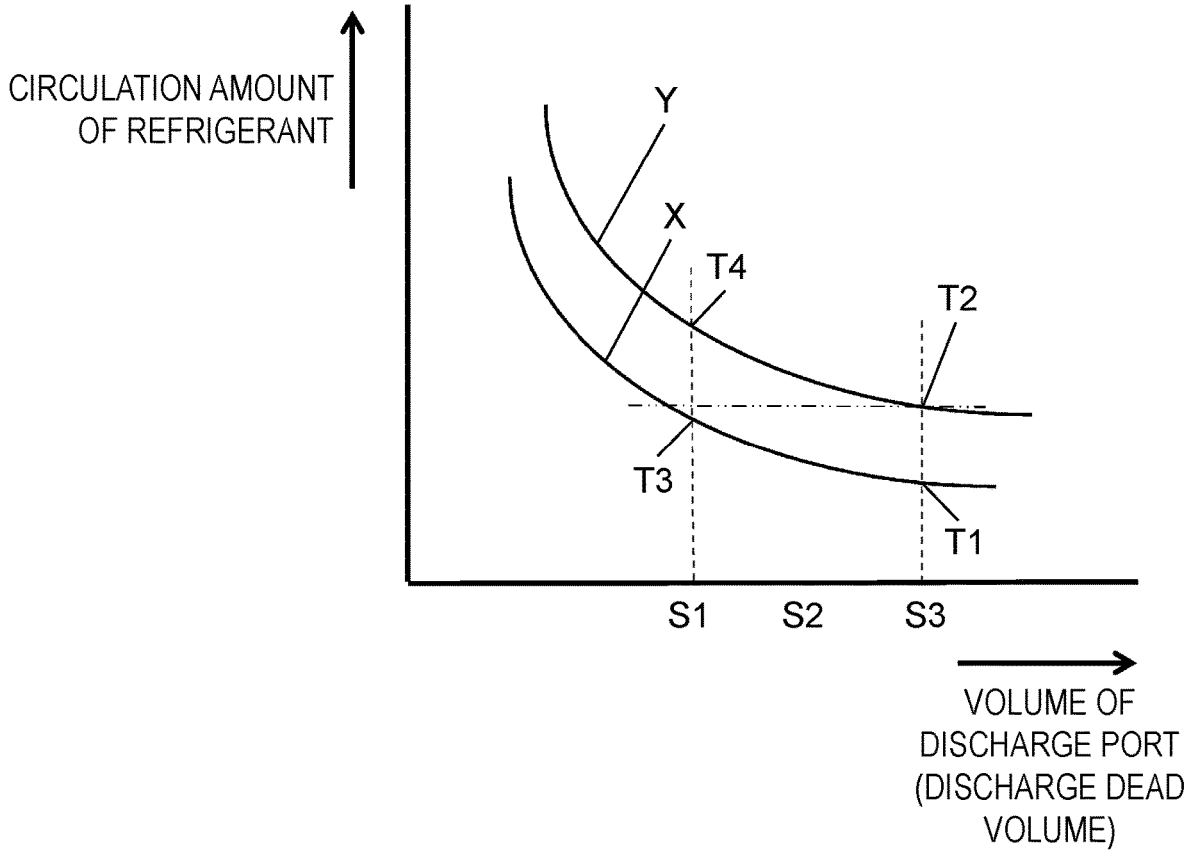
FIG. 4 is a graph showing one example of a characteristic showing a relationship between a volume of a discharge port and a circulation amount of a refrigerant of the compressor of the present disclosure.

FIG. 4 is a graph showing one example of a characteristic showing a relationship between a volume of a discharge port and a circulation amount of a refrigerant of compressor 50. In FIG. 4, X indicates a characteristic curve when no heat insulation configuration is adopted, while Y indicates a characteristic curve when a heat insulation configuration is adopted.

As is evident from FIG. 4, in a case where a heat insulation configuration is adopted, the characteristic curve Y applies, and compared to the characteristic curve X when no heat insulation configuration is adopted, the circulation amount of the refrigerant when volumes of the discharge port are S1, S2, and S3, respectively, increases up to respective positions of the characteristic curve Y.

In a case where a heat insulation configuration is adopted in which the thickness of fixed scroll 6 is increased, when the volume of the discharge port before the heat insulation configuration is adopted is S1, the volume of the discharge port increases from S1 to S3. Moreover, in a case where the volume of the discharge port is S3, the circulation amount of the refrigerant increases from T1 in the characteristic curve X, where no heat insulation configuration is adopted, to T2 in the characteristic curve Y, where the heat insulation configuration is adopted. However, when T2 indicating the circulation amount of the refrigerant in the characteristic curve Y is compared with T3 indicating the circulation amount of the refrigerant, where no heat insulation configuration is adopted, when the volume of the discharge port is S1, although the circulation amount of the refrigerant slightly increases, the increase is canceled by an increase in the volume of the discharge port (an increase in the discharge dead volume), and thus the circulation amount barely increases.

However, in the case where the heat insulation configuration in which the heat-insulating member is installed shown by the present exemplary embodiment is adopted, volume of discharge port S1 does not increase. This means that compared to the case where heat-insulating member 24 is not provided, the discharge dead volume can be maintained unchanged and minimum. Therefore, the circulation amount of the refrigerant in volume of discharge port S1 in the case where the heat insulation configuration is adopted is indicated by T4 in the characteristic curve Y. Accordingly, the circulation amount of the refrigerant greatly increases compared to T3 in the characteristic curve X.

In this way, in the case where the heat insulation configuration in which the heat-insulating member is installed shown by the present exemplary embodiment is adopted, the circulation amount of the refrigerant reliably increases and thus a highly efficient compressor can be achieved.

Moreover, in the present exemplary embodiment, in recess 27, opening 25 of heat-insulating member 24 has a rim having highest protruding shape 28. The portion having protruding shape 28 is strongly brought into pressure contact with the upper surface of fixed scroll 6. Accordingly, an area between muffler space 14 and recess 27 is strongly blocked. Therefore, a decrease in the heat insulation action by the refrigerant and oil inside recess 27 due to the circulation between the high-temperature and high-pressure refrigerant inside muffler space 14 and the refrigerant inside recess 27 is prevented. By so doing, the heat insulation effect by recess 27 improves. As a result, the influence of heat by the high-temperature refrigerant inside muffler space 14 is further strongly suppressed. Accordingly, a decrease in the circulation amount due to an increase in the temperature of the refrigerant is more effectively prevented, and an increase in the compression loss of the refrigerant is suppressed. As a result, a highly efficient compressor can be achieved.

Note that, for example, instead of the rim of opening 25 of heat-insulating member 24 in recess 27, an opening edge of recess 27 may have protruding shape 28. This means that at least one of the rim of opening 25 of heat-insulating member 24 in recess 27 and the opening edge of recess 27 may have protruding shape 28. Moreover, even when the surface facing fixed scroll 6 of heat-insulating member 24 is a plane surface, a configuration in which the rim of opening 25 provided in heat-insulating member 24 is fixed to fixed scroll 6 by a bolt prevents heat exchange due to the circulation between the refrigerant inside recess 27 and the high-temperature and high-pressure refrigerant inside muffler space 14. Further, through combination of provision of protruding shape 28 and fixing a bolt in the rim of opening 25, the effect of prevention of the heat exchange due to the circulation between the refrigerant in recess 27 and the high-temperature and high-pressure refrigerant inside muffler space 14 can be further increased.

In addition, as described in the exemplary embodiment, through a configuration in which a plurality of plates is laminated to form heat-insulating member 24, as described above, the heat insulation effect is enhanced, and the influence of heat upon fixed scroll 6 from muffler space 14 is more effectively suppressed.

Moreover, among the plurality of plates configuring heat-insulating member 24, when the thickness of plates facing fixed scroll 6 is thin, for example, when the thickness is as thin as approximately 1 mm, adhesion of the plates facing fixed scroll 6 to the upper surface of fixed scroll 6 improves. Accordingly, the circulation between the refrigerant inside recess 27 and the high-temperature and high-pressure refrigerant inside muffler space 14 is more reliably prevented. As a result, the heat insulation action by recess 27 is more effectively exerted.

Moreover, since heat-insulating member 24 is configured through lamination of plates provided with recess 27 and plates without a recess, recess 27 is formed without performing cutting. Therefore, heat-insulating member 24 can be provided at a low cost. In addition, since a plurality of plates provided with recess 27 and a plurality of plates without a recess are alternatively laminated, a plurality of recesses 27 is formed in a lamination direction. As a result, the heat insulation effect by recess 27 is further enhanced.

Note that the influence of heat from muffler space 14 described above and space inside container 15 into intake chamber 11 and compression chamber 9 is further suppressed through formation of a heat-insulating layer on heat-insulating member 24 and muffler 16. Examples of the heat-insulating layer include resin coating, and coating processing including hollow beads whose inside is vacuum or air. However, the heat-insulating layer is not limited to these examples.

As illustrated with reference to the exemplary embodiments described above, the present disclosure can achieve a highly efficient compressor by suppressing an increase in the temperature of the refrigerant, preventing a decrease in the circulation amount of the refrigerant, and suppressing an increase in the compression loss of the refrigerant. The present disclosure, however, is not limited to this exemplary embodiment. This means that the exemplary embodiment disclosed this time should be considered as illustrative in all respects and not restrictive. The scope of the present disclosure is defined by the terms of the claims, rather than the description above, and is intended to include any modifications within the scope and meaning equivalent to the terms of the claims.

INDUSTRIAL APPLICABILITY

As described above, the present disclosure can achieve a highly efficient compressor by, while maintaining a discharge dead volume of a refrigerant minimum, suppressing an increase in a temperature of the refrigerant, preventing a decrease in a circulation amount of the refrigerant, and suppressing an increase in a compression loss of the refrigerant. As a result, the present disclosure can be widely used for various equipment using a refrigeration cycle.

REFERENCE MARKS IN THE DRAWINGS

1, 107: airtight container
2: compression mechanism
3: electric motor
4: main bearing member
5: shaft
5*a*: eccentric shaft
6, 102: fixed scroll
7: revolving scroll
7*a*: route
8: rotation retaining mechanism
9, 103: compression chamber
10, 101: intake pipe
11: intake chamber
12, 104: discharge port
13: reed valve
14, 106: muffler space
15: space inside container
16, 105: muffler
16*a*: notch
17, 108: discharge pipe
18: pump
19: oil storage unit
20: oil supply hole
21: bearing
22: high pressure area
23: back pressure chamber
24: heat-insulating member
24*a*: through hole
25: opening
26: hole
27: recess
28: protruding shape
50: compressor

The invention claimed is:

1. A compressor comprising:

a fixed scroll and a revolving scroll configuring a compression mechanism;

a compression chamber formed between the fixed scroll and the revolving scroll;

an intake chamber provided on an outer circumferential side of the fixed scroll;

a discharge port provided in a central part of the fixed scroll;

a muffler provided to cover the discharge port at an upper part of the fixed scroll; and a heat-insulating member provided between the fixed scroll and a muffler space formed by the muffler, wherein after a refrigerant gas taken into the intake chamber is compressed by the revolving scroll revolving and the compression chamber moving while changing a volume of the compression chamber, the refrigerant gas is discharged from the discharge port, the refrigerant gas discharged from the discharge port is discharged into the muffler space, the heat-insulating member includes a recess provided between the muffler space and the intake chamber, the recess being provided on a surface on a side facing the fixed scroll, the recess is also provided in an area other than an area between the muffler space and the intake chamber, and a through hole is provided in a portion of the recess provided in the area other than the area between the muffler space and the intake chamber.

2. The compressor according to claim 1, wherein a portion close to the muffler space of the heat-insulating member is fixed to the fixed scroll by a bolt.

3. The compressor according to claim 1, wherein the heat-insulating member further includes a reed valve that opens and closes the discharge port and an opening that serves as a relief section of the reed valve, and in the heat-insulating member, at least one of a rim of the opening and an opening edge of the recess has a protruding shape most protruding toward a side of the fixed scroll.

4. The compressor according to claim 1, wherein the heat-insulating member is formed of a porous material.

5. The compressor according to claim 4, wherein the porous material is a sintered metal.

6. The compressor according to claim 1, wherein a plurality of plates is laminated to form the heat-insulating member.

7. The compressor according to claim 6, wherein the plurality of plates includes plates having the recess.

* * * * *